United States Patent [19]

Cipriani

[11] Patent Number: 5,052,260

[45] Date of Patent: Oct. 1, 1991

[54] ADJUSTABLE BRIDGE ASSEMBLY FOR ACOUSTICAL STRINGED INSTRUMENTS

[76] Inventor: Thomas Cipriani, 1441 Lincoln Rd. #411, Miami Beach, Fla. 33139

[21] Appl. No.: 496,794

[22] Filed: Mar. 21, 1990

[51] Int. Cl.[5] ..... G10D 3/04

[52] U.S. Cl. ..... 84/298

[58] Field of Search ..... 84/298, 299, 307, 308, 84/309, 313

[56] References Cited

U.S. PATENT DOCUMENTS

| | | | |
|---|---|---|---|
| 2,491,788 | 12/1949 | Widowson | 84/299 |
| 2,714,326 | 8/1955 | McCarty . | |
| 3,290,980 | 12/1966 | Fender | 84/307 |
| 3,605,545 | 9/1971 | Rendell | 84/307 |
| 4,135,426 | 1/1979 | Richard | 84/298 X |
| 4,248,126 | 2/1981 | Lieber | 84/299 |
| 4,308,784 | 1/1982 | Eizonas | 84/307 X |
| 4,425,832 | 1/1984 | Peavey | 84/298 |
| 4,430,919 | 2/1984 | Matsui | 84/299 |
| 4,464,970 | 8/1984 | Mischakoff | 84/298 |
| 4,768,414 | 9/1988 | Wheelwright | 84/298 |
| 4,867,030 | 9/1989 | Smith | 84/299 |

*Primary Examiner*—Brian W. Brown
*Attorney, Agent, or Firm*—Ladas & Parry

[57] ABSTRACT

A bridge assembly for a stringed musical instrument having a block-like platform member secured to a bridge member which is fixed with respect to a sound board cover of the instrument the bridge member has an upper surface with a groove therein seating of the platform member. The platform member has a lower portion fixedly inserted in the groove and an integral upper portion extending out of the groove and above said upper surface of the bridge member. A string of the instrument passes on a saddle under tension, the contact of the string with the saddle establishing the vibration length of the string. The saddle is connected to the platform member for longitudinal adjustment thereon to effect string length fine tuning. The saddle is movable between end positions at which the saddle remains positioned above the lower portion of the platform member so that vertical force applied to the saddle by the string will always be transmitted to the lower portion of the platform member therebelow and then to the bridge member and the sound board cover.

36 Claims, 10 Drawing Sheets

FIG. 15
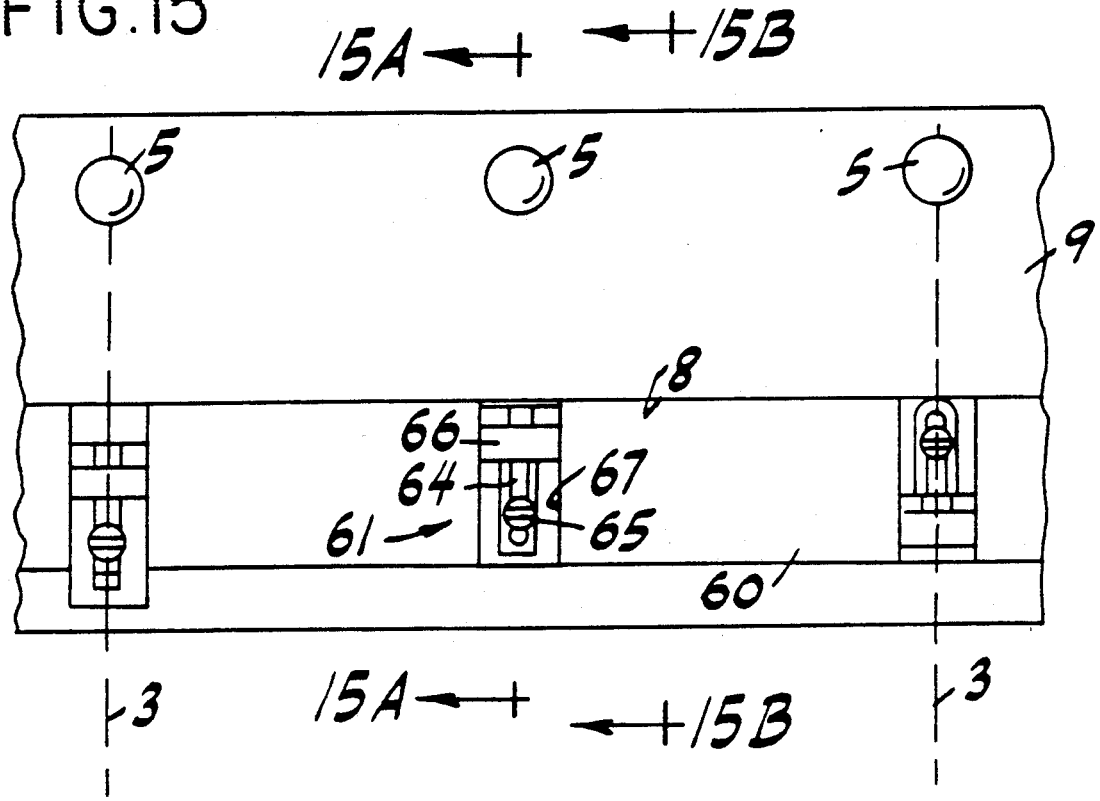
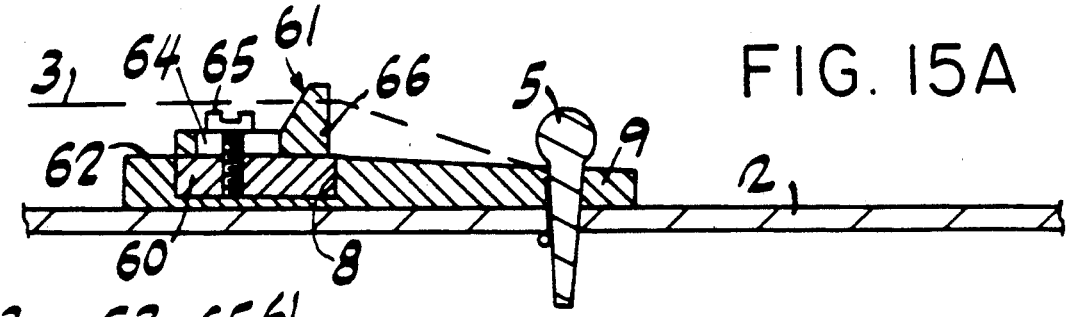
FIG. 15A
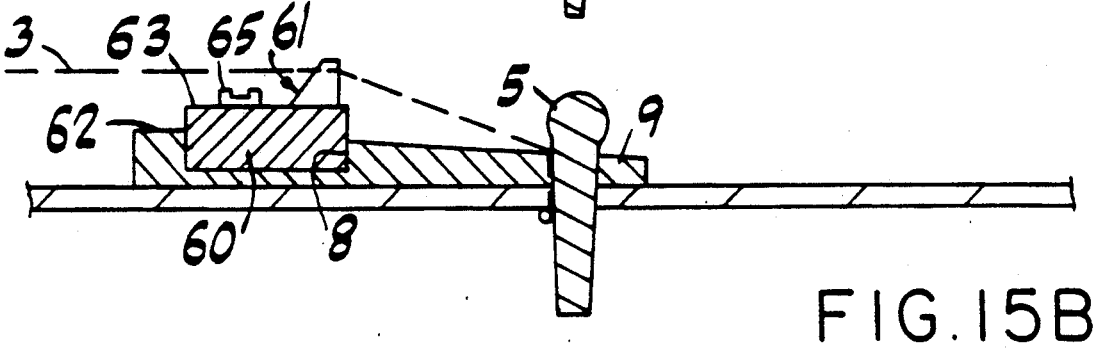
FIG. 15B

ADJUSTABLE BRIDGE ASSEMBLY FOR ACOUSTICAL STRINGED INSTRUMENTS

FIELD OF THE INVENTION

The invention relates to an adjustable bridge assembly for acoustical stringed instruments particularly for guitars.

More particularly, the invention relates to an adjustable bridge assembly in which a saddle of the assembly is longitudinally adjustable for adjusting string length fine tuning.

DESCRIPTION OF PRIOR ART

Adjustable bridge assemblies are well known in the art for adjusting string length fine tuning in order to adjust intonation of the string. Specifically, the vibration length of a string of a string musical instrument, such as a guitar, is measured from the nut to the point at which the string comes in contact with the bridge assembly, namely at the saddle. By providing longitudinal adjustment of the saddle the vibration length of the string is adjusted thereby achieving variation in string intonation.

The adjusting systems which are known in the art suffer from a number of disadvantages which the present invention seeks to overcome.

One of the most serious problems associated with the conventional systems is that they adversely affect the optimum sound of a given instrument. Namely, even though the vibration length of the string is adjusted this is associated with a dim emission of sound quality. An additional shortcoming of the existing systems is that they lack sufficient precision to provide easy adjustability for precise incremental variations in length. Other known systems are difficult to manufacture.

Wheelwright, U.S. Pat. No. 4,768,414 discloses an adjustable saddle of a bridge assembly for achieving string length fine tuning and the construction has the disadvantage that the adjustment leads to a deterioriation of the optimum sound of the instrument. Specifically, Wheelright shows a saddle which is adjustable longitudinally on an upper flat horizontal surface of a mounting block. The saddle is integrated with a tray plate which rides on the aforesaid surface. The tray plate overhangs the surface both at the front and the rear and when the saddle is longitudinally adjusted from a center position the force of the string acts on the saddle and this force is directly transmitted through the tray and the surface of the mounting block directly into the supporting bridge. The bridge is generally made of wood and it substantially dampens the vibrational energy of the string and the sound produced thereby. In this way, the wooden bridge intercepts the vibrational energy and thereby diminishes the energy which is transmitted to the sound board of the instrument.

Mischakoff U.S. Pat. No. 4,464,970 discloses a guitar bridge system which is also inefficient in the transmission of the string forces to the sound board. The saddle is in the form of a bent lever and forces applied to the saddle are transmitted to the backwall of the saddle insert effectively becoming lost energy.

Matsui U.S. Pat. No. 4,430,919 discloses a relatively complex arrangement of an adjustable saddle which suffers from the same disadvantage as Wheelwright in that the vibrational forces applied to the saddle are transmitted through the soft wood bridge to the sound board. In this patent the saddle is suspended on shoulders and its bottom does not directly contact the bridge.

Widowson U.S. Pat. No. 2,491,788 also discloses a relatively inefficient high damping adjustable saddle which is mounted in a large saddle holder which serves to damp string forces. The construction is relatively complex and employs a large number of parts and requires careful machining of shoulders and spring slots.

Fender U.S. Pat. No. 3,290,980 shows an adjustable bridge construction of relatively great complexity which employs a cylindrical saddle. The entire assembly rests on an intermediate damping bridge.

Peavey U.S. Pat. No. 4,425,832 shows an adjustable bridge which consists of two relatively adjustable angle shaped members. This arrangement lacks any development of separated vertical forces which produce a torque on the bridge leading to the basic transmission of vibratory energy to the sound board. In my copending application Ser. Nos. 446,215 and 213,157 now issued as U.S. Pat. No. 4,951,543 I have explained the significance of producing a downward push force at the bridge and an upward pull force at the string anchor wherein the separation between the forces is maximized in order to produce maximum torque on the sound board. In Peavey substantially the entire tensile force in the string is transmitted as a horizontal force to the string anchor which substantially deteriorates the sound produced by the instrument.

Rendell U.S. Pat. No. 3,605,545 discloses an adjustable bridge in which saddle members are slidably supported on a damping bridge in a relatively complex construction.

McCarty U.S. Pat. No. 2,714,326 discloses an adjustable bridge in which all of the string forces are transmitted horizontally to two screws. This has the disadvantage that no vertical string forces are transmitted directly from the saddle to the sound board.

Rickard U.S. Pat. No. 4,135,426 shows a movable saddle piece which has a gap between itself and the sound board whereby forces cannot be directly transmitted from the saddle to the sound board to maximize the separation between the push and pull forces.

Lieber U.S. Pat. No. 4,248,126 discloses an adjustable bridge assembly in which a combination of a saddle member and a base are adjustable longitudinally on a panel. The base acts as a damping means for the forces applied from the string to the saddle as in previously discussed constructions.

There are a number of additional constructions known in the art but these are similar and repetitive of the constructions which have been discussed above and suffer the same disadvantages.

SUMMARY OF THE INVENTION

An object of the invention is to provide a bridge assembly for a stringed musical instrument such as a guitar which has longitudinal adjustment for string length fine tuning and which incorporates individual saddle members for effecting the adjustment.

A further object of the invention is to provide such a bridge assembly which does not diminish the optimum sound of a given instrument upon longitudinal adjustment, has easy adjustability with precise increments of length adjustment and is simple and economical to manufacture.

A further object of the invention is to provide such a bridge assembly which incorporates means to transmit string force substantially directly to the sound board over the entire length of longitudinal adjustment.

In accordance with the above and further objects of the invention there is provided a bridge assembly which comprises a bridge member which is fixed relative to the sound board of the instrument, a block-like platform member resting on the bridge member and abutting against a front wall thereof and a saddle on which the string passes under tension, the contact of the string with the saddle establishing the vibration length of the saddle, said saddle being connected to the platform member by means which provides adjustment of the saddle on the platform member longitudinally of the string to effect string length fine tuning. The saddle is longitudinally adjustable between end positions at which the saddle remains positioned above the lower surface of the platform member so that vertical force components applied to the saddle by the string will be above the lower surface of the platform so that the vertical force components will be transmitted to the bridge member and the sound board cover via the lower surface of the platform member.

In a particular embodiment, the platform member rests in a deep groove in the bridge member so that the lower surface of the platform member will be in proximity to the surface of the sound board cover to minimize damping effect of the bridge member on vertical forces transmitted to the saddle member by the string.

The platform member can have a polygonal cross section preferably rectangular.

In order to lighten the weight of the platform member and still provide sufficient strength to transmit the string forces and lateral abutment forces the transverse cross section of the platform member can have an I-shaped cross section with upper and lower flanges abutting one another.

In a preferred embodiment, the cross sectional shape of the platform member is produced either by extrusion or pulltrusion.

BRIEF DESCRIPTION OF THE FIGURE OF THE DRAWINGS

FIG. 15 is a top plan view of a portion of a bridge assembly according to another embodiment.

FIG. 15A is a section taken along line 15A—15A in FIG. 15.

FIG. 15B is a section taken along line 15B—15B in FIG. 15.

DETAILED DESCRIPTION OF PREFERRED EMBODIMENTS

Figure 2A:
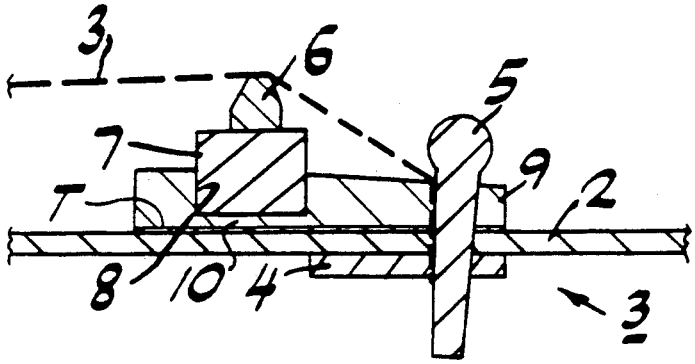
FIGS. 2A–2E are longitudinal sectional views of modifications of one embodiment of a platform member of the bridge assembly of the invention.

Referring to FIG. 2A therein is seen an embodiment of a bridge assembly 1 mounted on a sound board cover 2 of a resonating box 3 of a string musical instrument. The string 3 extends on the bridge assembly 1 where it undergoes a change of angle and the string is secured to the sound board cover 2 through the intermediary of a reinforcement 4 secured underneath the cover 2. The end of the string is secured to the reinforcing structure 4 by an anchor pin 5 which locks the end of the string in an aperture collectively formed in the bridge assembly, the cover 2 and the reinforcing structure 4.

The string 3 extends at its left end (not shown) over a nut to a tuning peg and the vibrational length of the string is established between its point of contact with the nut and its point of contact with the bridge assembly 1. In accordance with the invention the bridge assembly is constructed in a manner which will permit longitudinal adjustment of the vibrational length of the string commonly known as string length fine tuning adjustment. As a consequence of this string length adjustment, the intonation of the vibrating string will be adjusted and the construction of the invention seeks to achieve the maximum sound quality of the instrument without deterioration over the entire range of longitudinal adjustment of the bridge assembly.

The bridge assembly 1 comprises a saddle 6 which is supported for longitudinal adjustment on a block-like platform 7. The platform 7 is secured in a groove 8 formed in a base or bridge 9. The bridge 9 is secured to the sound board cover 2, for example, by gluing. The bridge 9 is generally made of a hardwood, such as ebony or rosewood. The groove 8 extends deeply into the bridge to leave a relatively thin portion 10 between the bottom of the platform 7 and the top of the sound board cover 2. Consequently, the amount of damping produced by the bridge on the vertical forces applied to the saddle 6 by string 3 will be minimized and therefore most of the vertical force will be transmitted from the saddle to the platform and then to the sound board cover 2.

Figure 1:
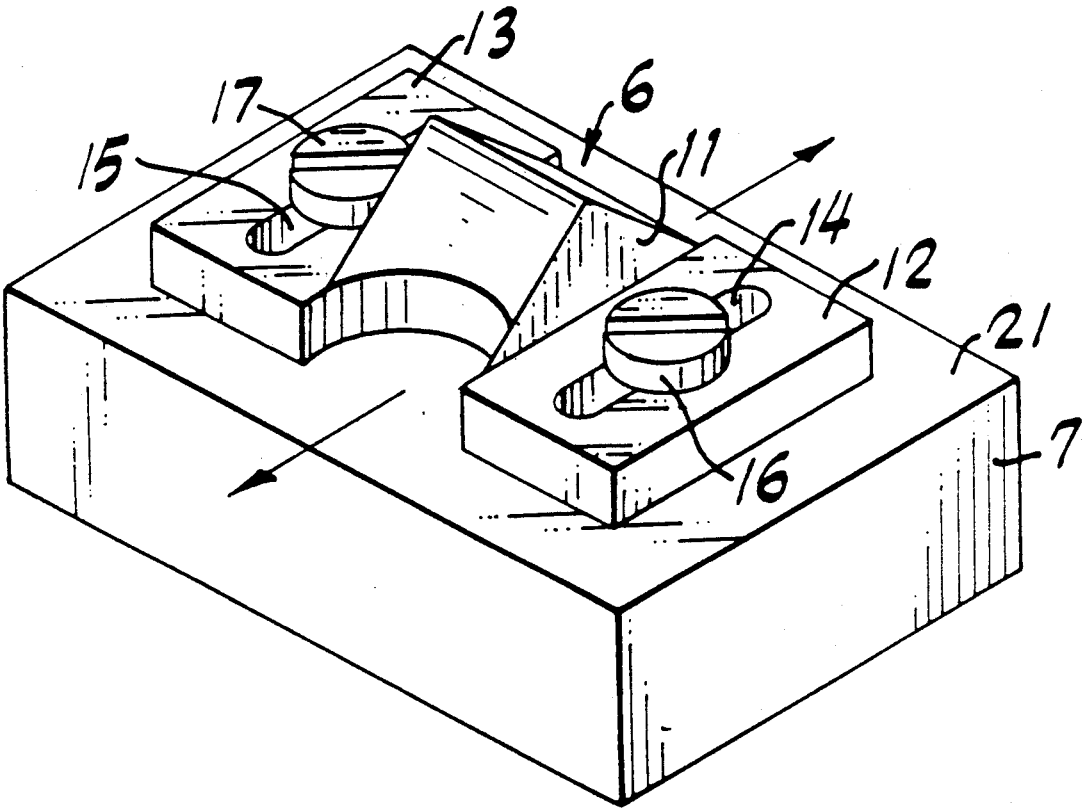
FIG. 1 is a perspective view from above of a portion of a bridge assembly according to the invention.
Figure 11B:
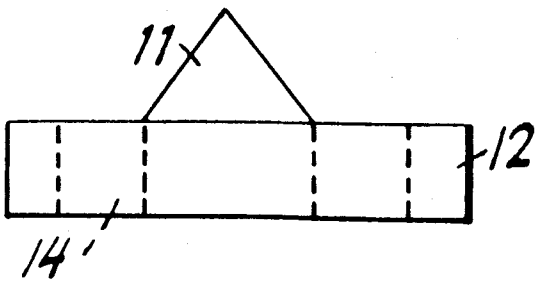
FIG. 11B is side elevational view of the saddle in FIG. 11.
Figure 11:
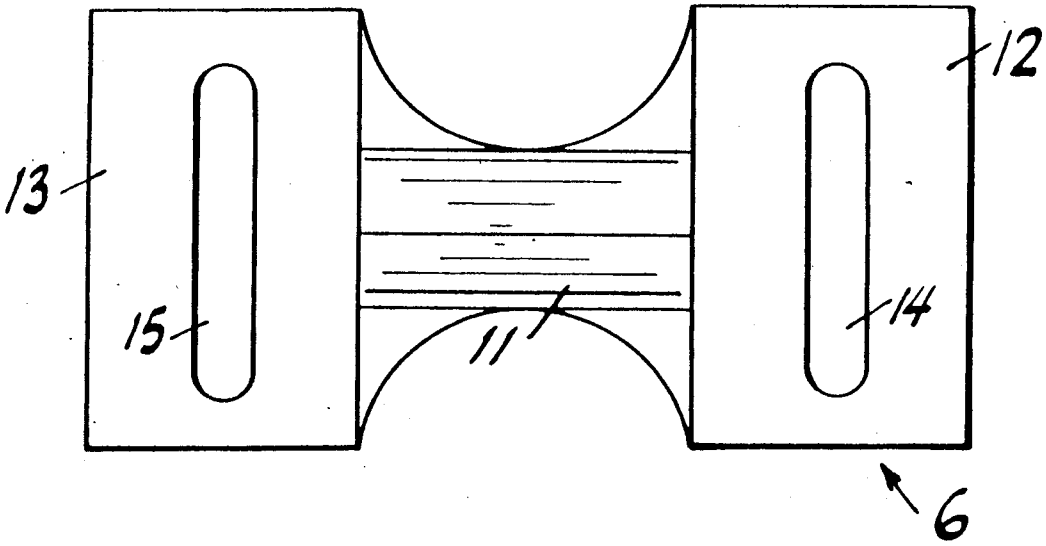
FIG. 11 is a top plan view of one embodiment of a saddle of the bridge assembly to the invention.
Figure 11A:
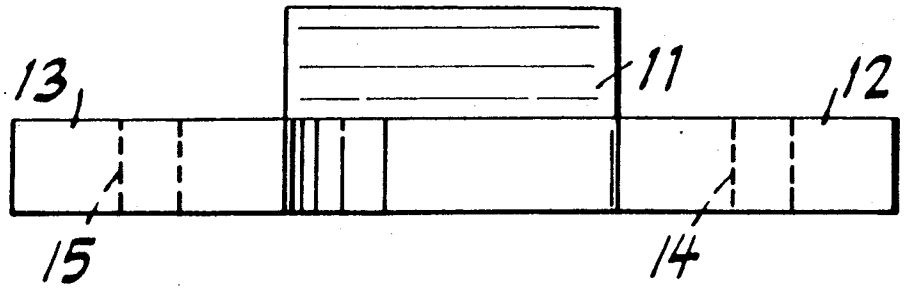
FIG. 11A is a front elevational view of the saddle in FIG. 11.

FIG. 1 shows the construction of the mounting means for the saddle 6 on the platform and FIGS. 11, 11A and 11B show the details of construction of the saddle 6 itself.

In FIGS. 1, 11, 11A, and 11B it is seen that the saddle 6 comprises a central body 11 of triangular cross section and two side portions 12,13 having respective longitudinal slots 14,15 therein as shown in FIG. 1. Extending in the slots 14,15, are fasteners 16,17 which are threadably engaged in platform 7. By loosening fasteners 16 and 17 the saddle 6 can be shifted longitudinally in the direction of the arrows so as to be moved forwardly or rearwardly on the platform. When the saddle has been adjusted to a desired position the fasteners 16 and 17 are tightened to secure the saddle in the adjusted position. The string 3 comes into contact with the apex of triangular portion 11 and vertical forces produced due to change of angle of the string are transmitted through the triangular portion substantially directly into the platform and therefrom through the thin portion 10 of the bridge 9 to the sound board cover 2.

Figure 2B:
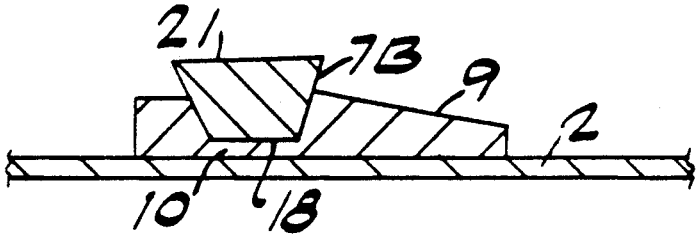

FIG. 2B shows a modified arrangement in which the saddle 6 and the string anchor have been omitted so that a different shape for the platform will be clear. In FIG. 2B the platform is designated 7B and it is seen that the platform is a trapezoid which widens in upwards direction. In FIG. 1, the saddle 6 can be longitudinally adjusted from the front edge of the platform to the rear edge thereof so that the vertical forces applied to the saddle will be transmitted through the platform to the thin portion 10 of the bridge and then to the sound board cover 2. In the embodiment of Fig. 2B the adjustability of the saddle is limited to the length of the lower surface 18 of the platform 7B so that the vertical forces will be confined to the relatively thin section 10 of the bridge 9 during the longitudinal adjustment of the saddle.

Figure 2C:
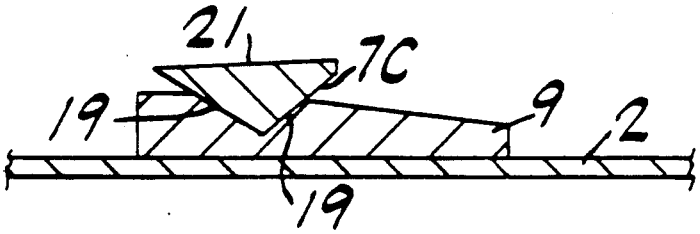

In FIG. 2C the platform 7C has a substantially triangular cross section and the force applied to the saddle will be transmitted through the platform 7C to angular surfaces 19 of bridge 9 and then to the sound board cover 2. This arrangement is less efficient than the arrangement in FIGS. 2A and 2B due to the greater damping of the vertical forces by the bridge member.

Figure 2D:
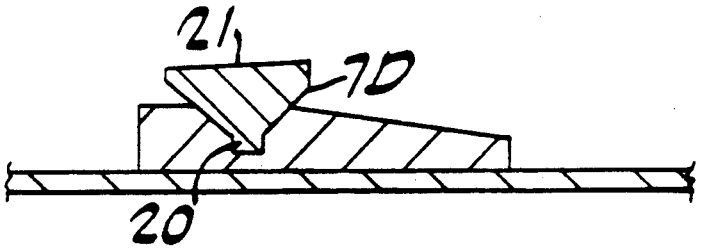
Figure 2E:
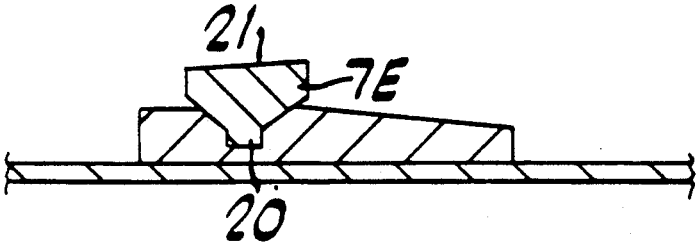

Modifications of the platform are shown in FIGS. 2D and 2E at 7D and 7E. In these embodiments a locking tab 20 extends at the bottom apex of the triangular platform and in FIG. 7D the projection 20 is centered with respect to the platform while in platform 7E in FIG. 2E it is more forwardly disposed at the bottom of the platform.

In FIGS. 2A–2E the platform is seated fixedly in groove 8 of the bridge 9 and the upper surface 21 of the platform projects above the upper surface of the bridge and has no underlying support by said upper surface. All of the walls of the platform are straight and confer a polygonal cross sectional shape thereto. In order to minimize the damping effect of the bridge 9 on the vibrational forces transmitted through the platform and bridge to the sound board, the length of the groove 8 at the upper surface of the bridge 9 is greater than the depth of the groove 8.

Figure 3:
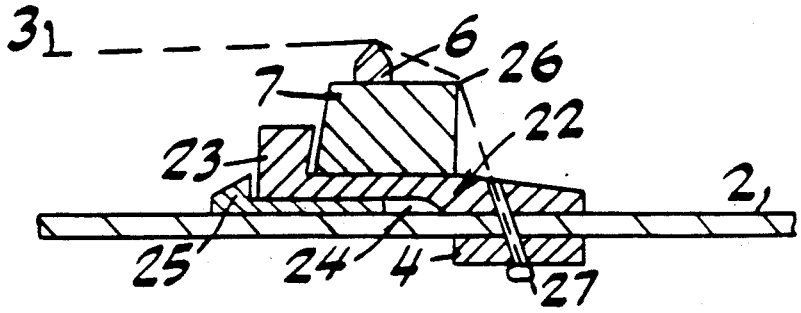
FIGS. 3–7 are longitudinal sectional views showing further embodiments of the bridge assembly of the invention.

FIG. 3 shows an arrangement of platform 7 and saddle 6 which is similar to that of FIG. 2A but in FIG. 3 the bridge is modified in that bridge 22 incorporates a front wall 23 against which platform 6 abuts. A notch 24 is provided at the front wall of the bridge and notch 24 extends transversely of the bridge. An insert or wedge member 25 extends in the notch 24. The string 3 contacts saddle 6 and the upper right edge 26 of platform 7 thereby the string makes two points of contact with the bridge assembly before it is anchored at 27 to the reinforcing structure 4 at the bottom of sound board cover 2. This bridge construction intended to maximize the separation between the vertical push forces applied by the string to the saddle 6 and transmitted to the sound board cover 2 and the pull forces applied by the string to the sound board cover 2.

Figure 4:
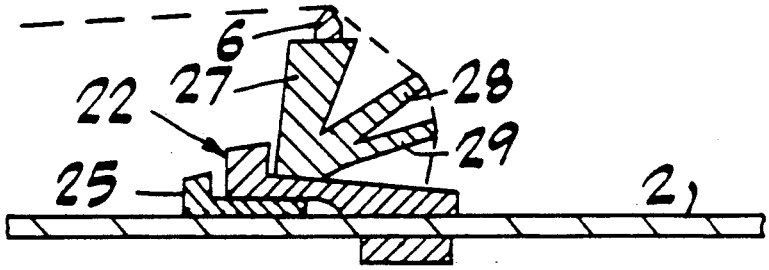

FIG. 4 shows a modified arrangement of FIG. 3 in which instead of a rectangular platform, if is reduced in weight as shown in FIG. 4 by formation of three distinct legs 27, 28 and 29. The legs 27, 28 and 29 are angularly separated to form spaces between respective legs and the string comes into contact with each of legs 27, 28 and 29. The saddle 6 is adjustably mounted on leg 27 and determines the vibrational length of the string. By virtue of the arrangement shown in FIG. 4 the forces applied by the string to the legs 27, 28 and 29 are transmitted through the legs to the front of the bridge for transmission to the sound board cover 2 at a location which is maximally spaced from the upward pull force applied to the sound board cover by the string at its anchor 27. In this way a maximum torque is applied through the bridge assembly to the sound board cover.

Figure 5:
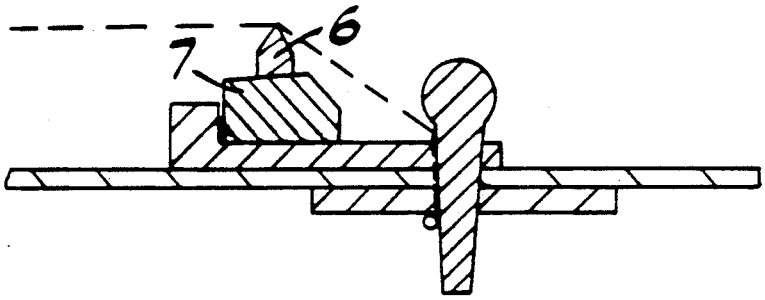

FIG. 5 shows an arrangement similar to that in FIG. 2A where the back of the bridge has been removed so that the groove 10 extends all the way to the rear surface of the bridge.

Figure 6:
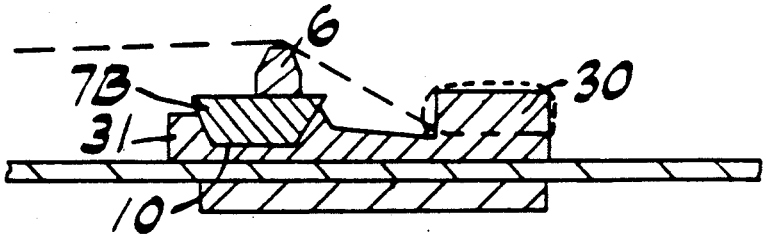

FIG. 6 is similar to FIG. 2B except that the anchoring of the end of the string is not directly to the sound board cover but rather is made through an upstanding pavilion 30 at the back of the bridge member 31.

Figure 7:
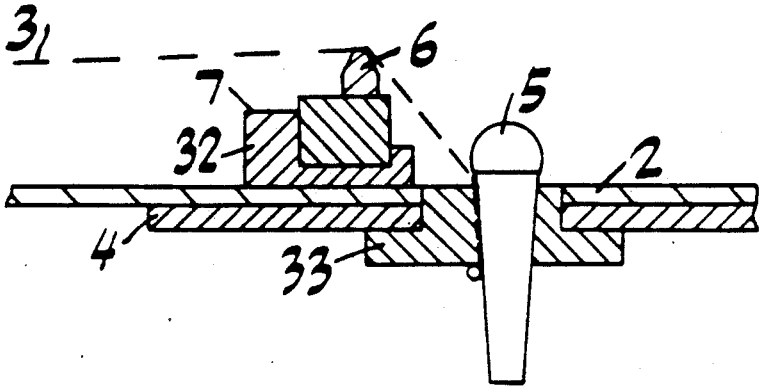

FIG. 7 is similar to FIG. 2A except that instead of anchoring the string through the bridge member the bridge member 32 is shortened and the string extends directly to the sound board cover 2 for anchoring through the pin 5 through a locking member 33 secured to the underside of the reinforcing structure 4.

Figure 8:
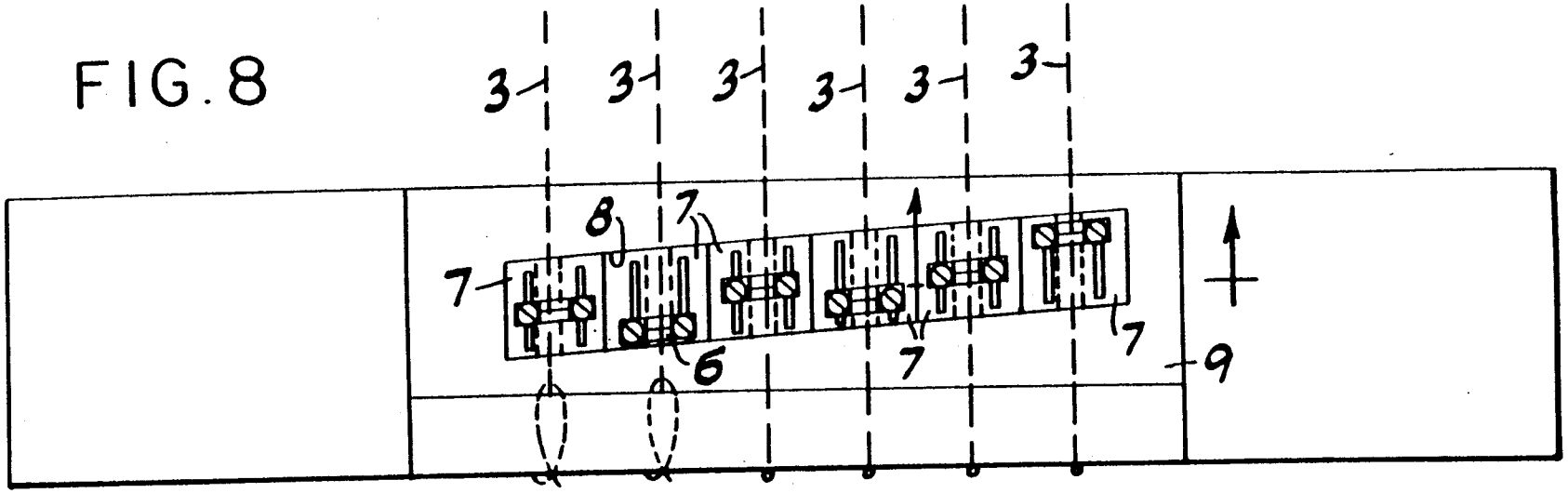
FIG. 8 is a top plan view of another embodiment of the bridge assembly according to the invention.

In FIG. 8 it is seen that the groove 8 in the bridge 9 extends at an angle with regard to the perpendicular to the longitudinal direction of the strings. Although not shown the groove 8 may also extend substantially parallel to bridge 9. Each string includes a respective supporting saddle mounted on its own platform and the platforms abut one another and are interfitted in the groove 8. It is also within the contemplation of the invention to provide a single one piece platform for all the strings.

Figure 9A:
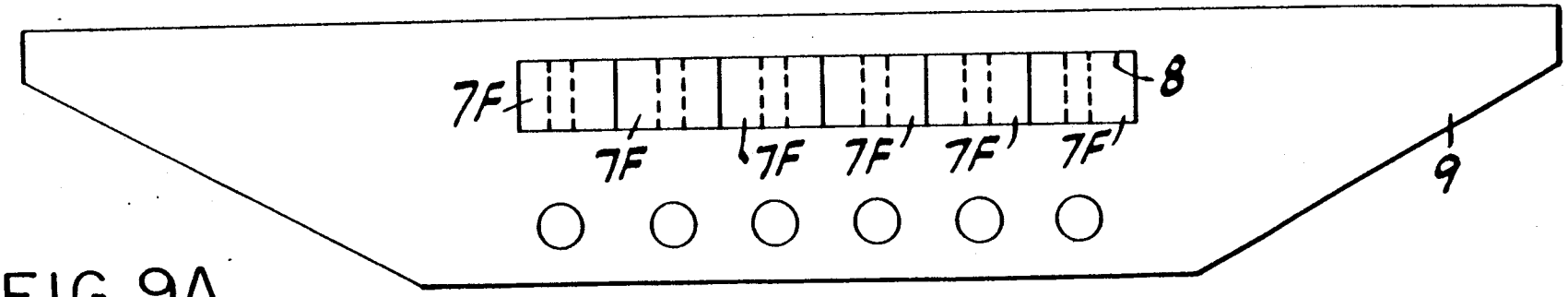
FIG. 9A is a top plan view of a portion of a modified bridge assembly according to the invention.
Figure 10:
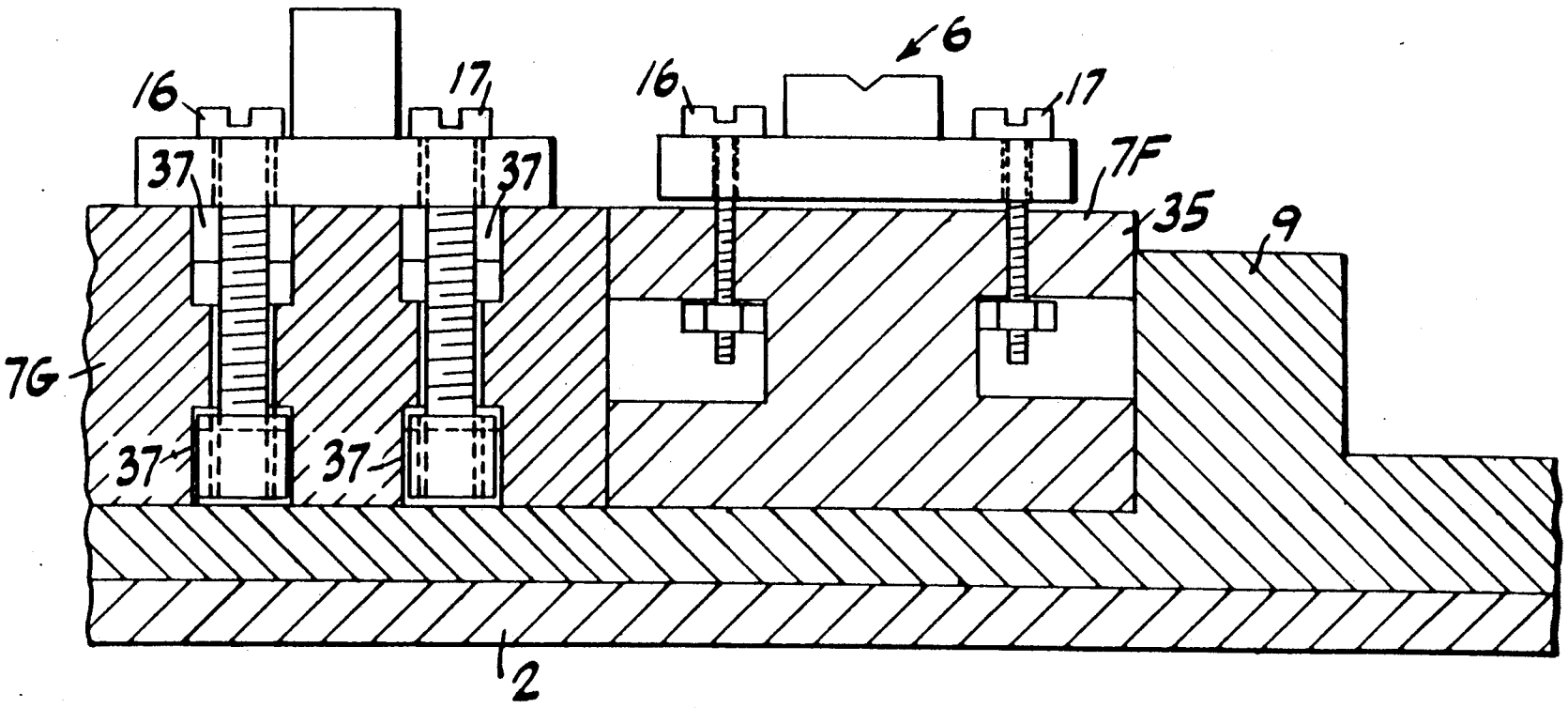
FIG. 10 is a sectional view taken on line 10—10 in FIG. 8.

FIG. 9A shows the bridge 9 and the groove 8 is perpendicularly transverse therein and the platform members 7F are of I-section having upper and lower flanges 35 and 36 respectively in lateral abutment with one another. FIG. 10 is an enlarged view showing the platform 7F at the right lateral end and also visible is the saddle 6 secured to the platform 7F by fasteners 16 and 17. The fasteners 16 and 17 attach the saddle to the upper flange 35 of the platform 7F. Adjacent to platform 7F at the left thereof in FIG. 10 is a modified platform 7G in which instead of an I-shaped section the platform is provided with slots 37 which receive the fasteners 16 and 17. The fasteners 16 and 17 are constituted as bolts and nuts which provide a gripping function and the lower surface of the saddle and/or the upper surface of the platform can have teeth to increase the gripping action.

Figure 12:
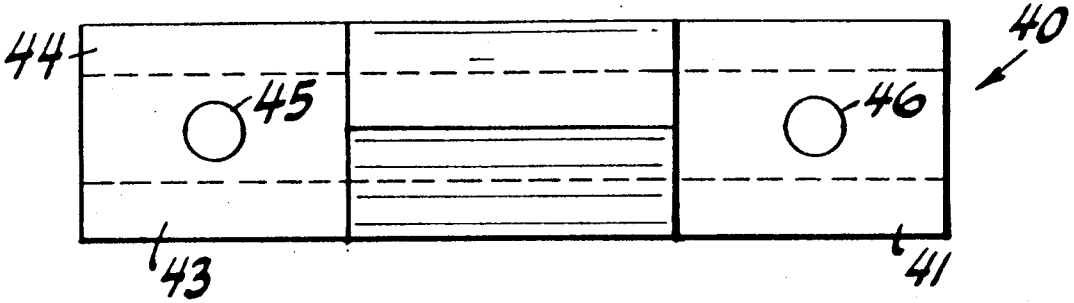
FIG. 12 is a top plan view of another embodiment of a saddle of the bridge assembly according to the invention.
Figure 12A:
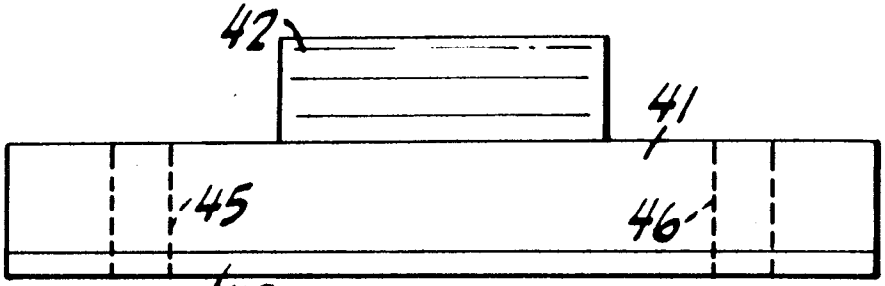
FIG. 12A is a front elevational view of the saddle in FIG. 12.
Figure 12B:
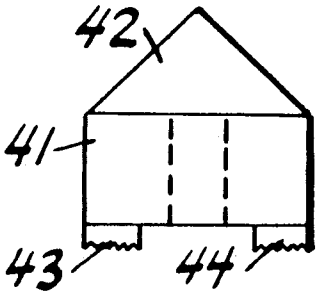
FIG. 12B is a side elevational view of the saddle in FIG. 12.
Figure 9B:
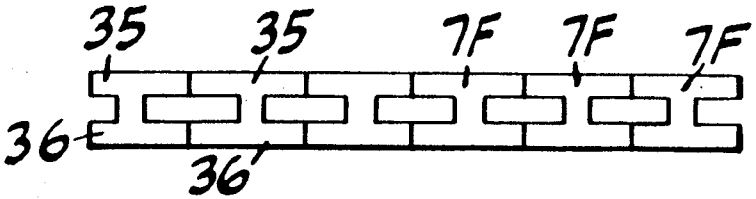
FIG. 9B is an elevational view of a platform member of the bridge assembly in FIG. 9A.

FIGS. 12, 12A and 12B show another embodiment of the saddle designated by numeral 40 In this embodiment the saddle has a base 41 of rectangular outline with a triangular raised portion 42 which contacts the string. The saddle includes transversely extending legs 43,44 at the bottom of portion 41 and these legs have sharp jagged lower edges which serve as a gripping means for better contact with the upper surface of the platform. The upper surface of the platform can be provided with teeth to mate with the lower surface of the legs 43 and 44 in order to lock the saddle on the platform. The saddle 40 is provided with circular bores 45,46 which receive the fasteners 16 and 17. In this embodiment longitudinal adjustment of the position of the saddle 40 is achieved by loosening the fasteners 16 and 17 and displacing the saddle 40 on the platform 7G. In the course of the longitudinal displacement, the fasteners remain in bores 45 and 46 and travel in longitudinal slots 37 in the platform. When the saddle has reached its adjusted position the fasteners are tightened to secure the saddle in said adjusted position.

Figure 14A:
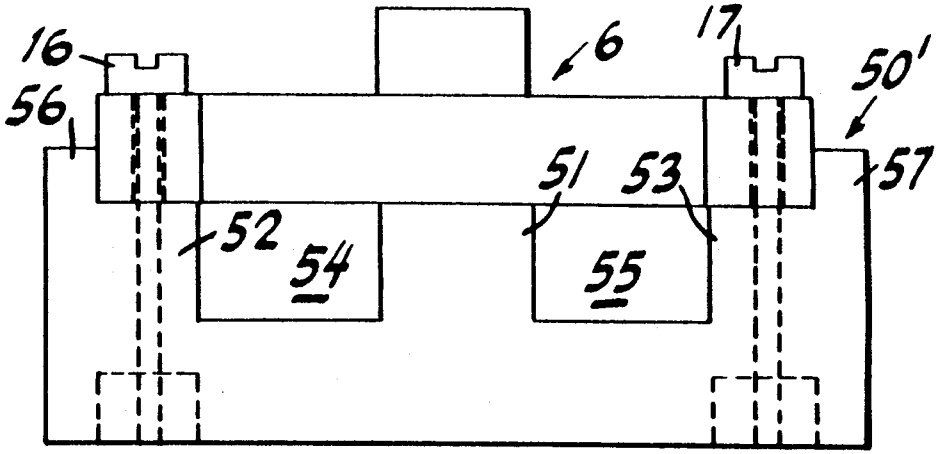
FIG. 14A is a front elevational view of a modified platform member with a saddle mounted thereon.
Figure 14B:
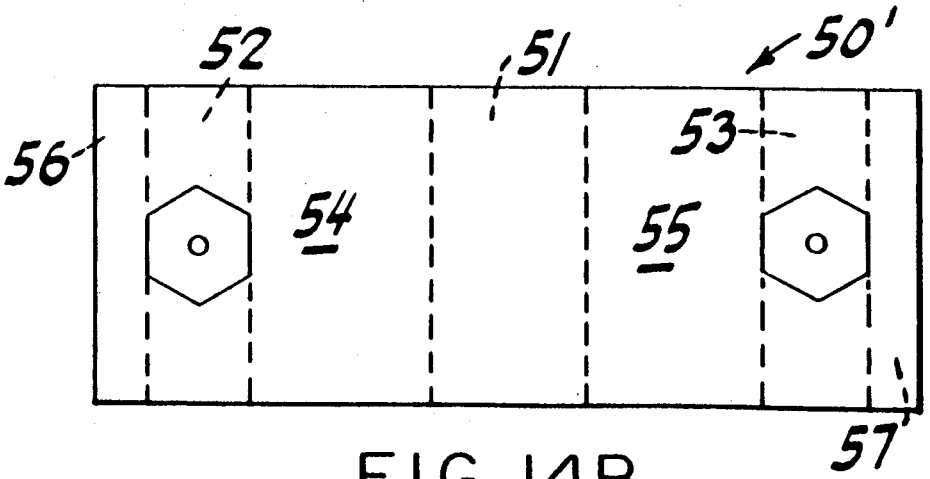
FIG. 14B is a bottom plan view of the assembly in FIG. 14A.
Figure 13:
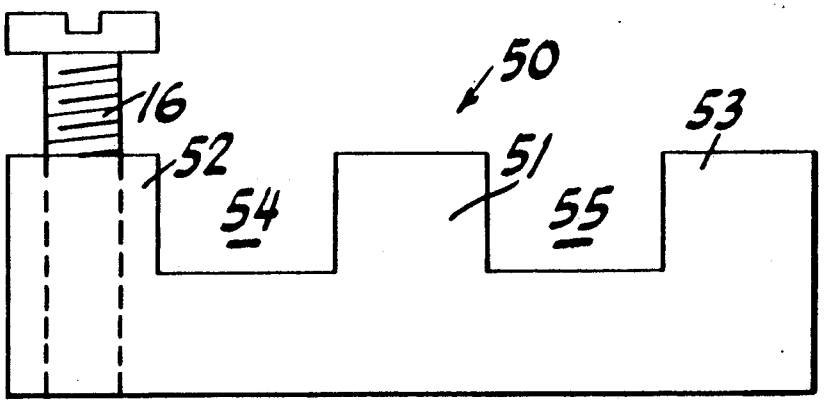
FIG. 13 is a front elevational view of a platform member of the bridge assembly according to one embodiment thereof.

FIGS. 13, 14A and 14B show another embodiment of the platform designated by numeral 50. This embodiment is intended to reduce the weight of the solid block-like platform shown in FIG. 2A. The platform 50 includes a central support portion 51 and two end support portions 52 and 53 spaced from central support portion 51 to define therewith longitudinal spaces 54 and 55. A fastener is secured in each of the end portions although in FIG. 13 only the fastener 16 at the left end is shown. As seen in FIG. 14A saddle 6 is supported on a modified platform 50' which differs from that in FIG. 13 by the provision of longitudinal retaining rims 56 and 57 at the ends of the end portions 52 and 53. The saddle 6 is supported on the end portions 52 and 53 and abuts against the retaining rims 56 and 57. Fasteners 16 and 17 are threadably secured in the platform and saddle 6 is longitudinally adjustable on the platform in the manner as shown in FIG. 1.

FIGS. 15, 15A and 15B show a further embodiment of the bridge assembly of the invention. In these figures the bridge 9 is formed with transverse groove 8 in which is fitted a platform 60. In the regions of the platform where the saddles are mounted, the surface of the platform 60 is lowered and made flush with the surface 62 of the bridge. Outside these regions the surface 63 of the platform extends above the surface 62 of the bridge. This is evident from Figs. 15A and 15B. The saddle 61 is formed as an integral member with a single slot 64 in which a fastener 65 extends and is threadably engaged with the platform 60. In order to adjust the longitudinal position of the saddle 61 the fastener 65 is loosened and the saddle is longitudinally displaced forwardly or rearwardly. When the adjusted position of the saddle has been reached the fastener 65 is tightened. The saddle includes an upstanding portion 66 on which the string 3 passes and in the foremost and rearmost positions the contact point of the string with the projection 66 lies above the surface of the platform 60 so that vertical force will be transmitted through the platform to the sound board cover. This embodiment is somewhat simpler than that of FIG. 1 since only a single fastener is employed. The longitudinal position of the saddle is maintained by the engagement of the shank of the fastener 65 in the slot 64 with relatively little clearance and the sides of the upstanding portion 66 are retained by the shoulders 67 formed between the different levels of the platform 60 at the regions where the saddle is slidably mounted.

Figure 16:
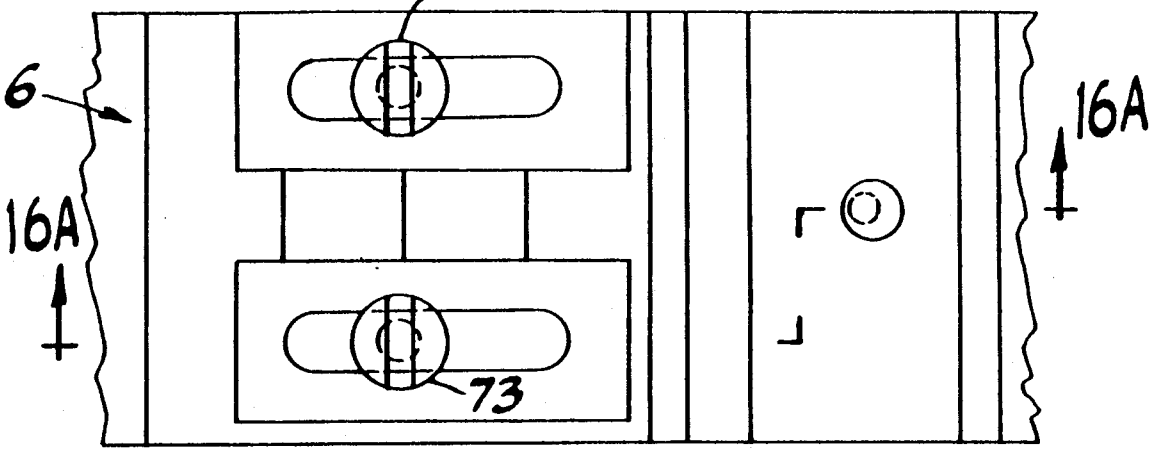
FIG. 16 is plan view of another embodiment of the bridge according to the invention.
Figure 16A:
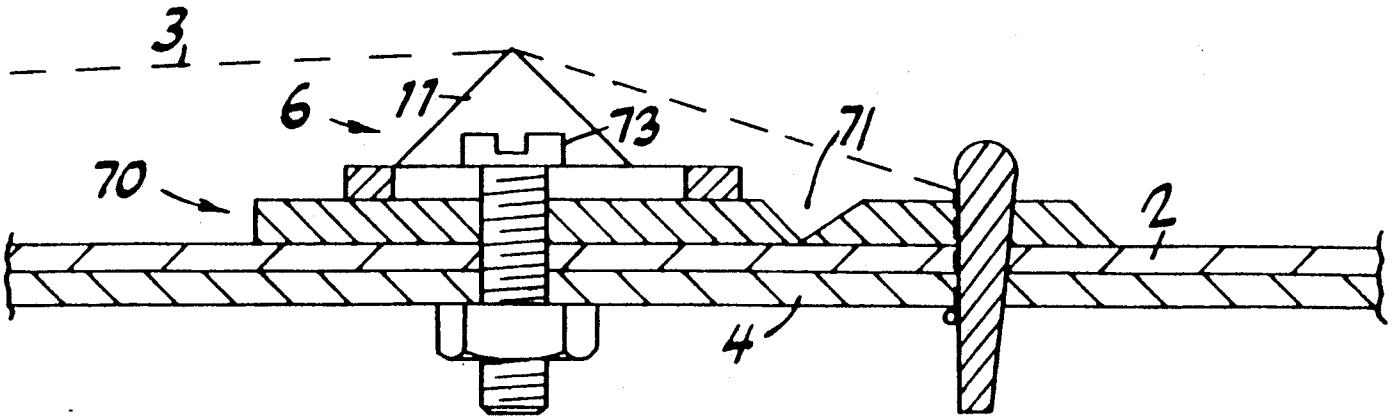
FIG. 16A is a section taken along line 16A—16A in FIG. 16.

FIGS. 16 and 16A show another embodiment of the bridge assembly and herein the saddle 6 is mounted on a platform 70 which is relatively flat and is itself secured to the sound board cover 2 without the intermediary of a base or bridge. The platform 70 is formed with a transverse notch 71 located rearwards of the apex of the triangular portion 11 of the bridge even when the latter is in its rearmost position As a consequence there is complete separation between the downward push force applied to the sound board cover through the intermediary of the saddle and the platform and the upward pull force applied by the string to the sound board cover. In the absence of the notch both the upward and downward forces can be laterally transferred to directly oppose one another and undesirably minimize the torque produced by the string on the sound board cover. The saddle 6 is directly secured to the reinforcing structure 4 beneath the sound board 2 by fasteners 72 and 73.

As evident from the above constructions of the bridge assembly of the invention, the push forces applied by the string to the saddle are transmitted directly through the platform to the sound board and there is only minimum interference from the bridge as the platform is brought as close as possible to the sound board. In general the total amount of longitudinal adjustment movement of the saddle is about ⅜" and the top surface 21 of the platform on which the saddle rests has a longitudinal dimension of about ½".

The saddle and platform are made of a light but dense material such as ivory. Other suitable materials include carbon fibers, molded graphite and ceramic silicon compounds particularly ceramic silicon nitride. Ceramics with superconductive properties are also suitable as are metal alloys, metal matrixes, composites reinforced with ceramic fibers, ceramic matrix composites, monolithic ceramics, carbon fiber composites, quartz crystal material and man made quartz. A conventional transducer T (FIG. 2A) can be mounted on the sound board cover to amplify sound produced by the strings. Alternatively, the transducer T can be mounted between the saddle 6 and the platform 7 or between the platform 7 and the bridge as explained in U.S. Pat. No. 4,951,453.

Although the invention has been described in relation to specific embodiments thereof it will become apparent to those skilled in the art that numerous modifications and variations can be made within the scope and spirit of the invention as defined in the attached claims.

What is claimed is:

1. A bridge assembly for a stringed musical instrument having adjustment for string length fine tuning, the musical instrument having a resonating box with a sound board cover on which the bridge assembly is mounted, said bridge assembly comprising a bridge member fixed with respect to the sound board cover of the musical instrument, a block-like platform member secured to said bridge member, said bridge member having an upper surface with a groove therein for said platform member, said platform member including a lower portion fixedly inserted in said groove, a saddle on which a string passes under tension, the contact of the string with the saddle applying vertical force to the saddle and establishing a vibration length of the string, said block-like platform member projecting from said groove to provide an upper support surface for said saddle which has no underlying contact with said upper surface of said bridge member so that the force applied to the saddle will be substantially entirely transmitted through the lower portion of the platform member to the sound board cover via said groove in the bridge member without being transmitted to the upper surface of the bridge member and means connecting the saddle to the platform member, for adjustment of the saddle, longitudinally of the string, on the platform member to vary the vibration length of the string and thereby effect string length fine tuning and for longitudinally adjusted positions of the saddle between end positions the saddle transmits the vertical force applied thereto by the string substantially entirely to said lower portion of the platform member therebelow and then to said sound board cover via the groove in the bridge member.

2. A bridge assembly as claimed in claim 1 wherein said platform member has a polygonal cross section.

3. A bridge assembly as claimed in claim 1 wherein said platform includes an integral upper portion extending out of said groove and above said upper surface of said bridge member.

4. A bridge assembly as claimed in claim 1 wherein said platform member has front and rear surfaces which are rectilinear and continuous at said upper surface of the bridge member whereat the platform member exits from said groove.

5. A bridge assembly as claimed in claim 1 wherein one said platform member is provided for a respective string such that for a plurality of strings a plurality of platform members are provided.

6. A bridge assembly as claimed in claim 5, wherein said platform members are in sidewise abutment with one another.

7. A bridge assembly as claimed in claim 6 wherein each platform member has an I-shaped transverse cross section with upper and lower flanges abutting one another.

8. A bridge assembly as claimed in claim 1 wherein said means connecting the saddle to the platform member comprises releasable fasteners between said saddle and said platform member on opposite sides of said string.

9. A bridge assembly as claimed in claim 8 wherein said saddle comprises an upright portion on which said string is supported, said releasable fasteners connecting said saddle to said platform member on opposite sides of said upright portion for relative longitudinal adjustment of said saddle and said platform member.

10. A bridge assembly as claimed in claim 9 wherein said saddle including longitudinally grooved sections on opposite sides of said upright portion, receiving said fasteners.

11. A bridge assembly as claimed in claim 10 wherein said platform member has end portions beneath said longitudinally grooved sections of said saddle, a central support portion beneath said upright portion of the saddle, and longitudinal grooves between said central support portion and said end portions, said saddle resting on said end portions and said central portion.

12. A bridge assembly as claimed in claim 10 wherein said upright portion of the saddle extends as a narrow transverse bridge between said longitudinally grooved sections.

13. A bridge assembly as claimed in claim 12 wherein said upright portion of the saddle has a triangular cross-sectional shape.

14. A bridge assembly as claimed in claim 1 wherein said platform member has material removed to reduce weight.

15. A bridge assembly as claimed in claim 1 wherein said platform member has a groove for longitudinal adjustment of said saddle therein.

16. A bridge assembly as claimed in claim 1 wherein at least one of said saddle and platform member is made of carbon fiber composites, graphite, or ceramics.

17. A bridge assembly as claimed in claim 16 wherein said ceramics are selected from the group consisting of ceramic silicon compounds, ceramics with superconductive properties, and ceramic fiber composites.

18. A bridge assembly as claimed in claim 1 comprising transducer means for electronic amplification of the sound produced by string vibration.

19. A bridge assembly for a string musical instrument having adjustment for string length fine tuning, the musical instrument having a resonating box with a vibratable sound board cover on which the bridge assembly is mounted, said bridge assembly comprising a bridge member fixed with respect to the sound board cover of the musical instrument, said bridge member including an upstanding wall, a block-like platform member having a lower surface resting on said bridge member and a front surface abutting against said wall such that said platform member is in secure engagement with said bridge member, a saddle on which a string passes under tension, the contact of the string with the saddle establishing a vibration length of the string, said bridge member having a relatively thin portion on which the platform rests, said platform member projecting upwardly from said thin portion of the bridge member above the upstanding wall of the bridge member to provide an upper support surface for said saddle which has no underlying contact with said bridge member so that said force applied by the string to the saddle will be substantially entirely transmitted through the platform member to the sound board cover via said thin portion of the bridge member, and means connecting the saddle to the platform member for adjustment of the saddle on the platform member longitudinally of the string to vary the vibration length of the string, and thereby provide string length fine tuning, said means providing end positions for longitudinal adjustment of the saddle at which the saddle transmits vertical force components from the string to the sound board cover exclusively via said thin portion of the bridge member. will be transmitted to the bridge member and the sound board cover via said lower surface of the platform member.

20. A bridge assembly as claimed in claim 17 comprising a second upstanding wall on said platform spaced rearwardly of the first said wall whereby the first wall is a front wall and the second wall is a rear wall, said platform member being disposed between and engaged with said front and rear walls.

21. A bridge assembly for a string musical instrument having adjustment for string length fine tuning of individual strings of the instrument, said instrument having a resonating box with a vibratable sound board cover on which the bridge assembly is mounted, said bridge assembly comprising a bridge member fixed with respect to the sound board cover of the musical instrument, said bridge member including a portion of reduced thickness providing a relatively thin portion, a block-like platform member securely engaged in said portion of reduced thickness of said bridge member and having an upper surface disposed above said bridge member, a plurality of saddles on each of which at least one string passes under tension and makes contact with the saddle at a point establishing a vibration length of the string and means connecting each saddle to the platform member for adjustment longitudinally of the respective string to vary the vibration length of the string and thereby effect string length fine tuning thereof, each saddle including spaced longitudinal side portions and a transverse portion connecting said side portions, said transverse portion projecting upwardly to a level above said side portions at a position such that the sting contacts and is supported by said transverse portion, said connecting means including releasable fasteners releasably connecting said side portions of the saddle and said platform member on opposite sides of said string and providing front and rear end positions for longitudinal adjustment of the saddle on the platform member, said transverse portion of the saddle being entirely positioned above said platform member in both said front and rear end positions as well as intermediate positions therebetween so that vertical forces applied to the saddle by the string will be transmitted downwardly on the sound board cover via the block-like platform member and the thin portion of the bridge member.

22. A bridge assembly as claimed in claim 21 wherein said side portions have respective longitudinal slots therein, said fasteners being engaged in said slots and in said platform on opposite sides of said transverse portion.

23. A bridge assembly for a musical instrument having a plurality of strings provided with adjustment for string length fine tuning of each string, the musical instrument having a resonating box with a sound board cover on which the bridge assembly is mounted, said bridge assembly comprising a bridge member fixed with respect to the sound board cover of the musical instrument, a block-like platform member secured to said bridge member, said bridge member having an upper surface with a groove therein for said platform member, said platform member including a lower portion fixedly inserted in said groove, a plurality of saddles on which respective strings pass under tension, a contact of each string with the respective saddle applying vertical force to the saddle and establishing a vibration length of said string, said block-like platform member being a one-piece member supporting all the saddles and projecting from said groove to provide an upper support surface for said saddles with no underlying contact with the upper surface of the bridge member so that forces applied to the saddles will be substantially entirely transmitted through the lower portion of the platform member to the sound board cover via said groove in the bridge member without being transmitted to the upper surface of the bridge member and means connecting the saddles to the platform member, for individual adjustment of the saddles, longitudinally of the strings, on the platform member to vary the vibration length of the strings and thereby effect string length fine tuning of the strings, said means providing end positions for longitudinal adjustment of each of the saddles such that for all longitudinally adjusted positions of each saddle vertical force applied to said saddle by the respective string will be transmitted to said lower portion of the platform member and then to said sound board cover via the groove in the bridge member without transmission of force to the upper surface of the bridge member.

24. A bridge assembly as claimed in claim 23 wherein said means connecting the saddles to the platform member comprises, for each saddle, releasable fasteners between said saddle and said platform member.

25. A bridge assembly as claimed in claim 24 wherein said saddle comprises an upright portion on which said string is supported, said releasable fasteners connecting said saddle to said platform member on opposite sides of said upright portion for relative longitudinal adjustment of said saddle and said platform member.

26. A bridge assembly as claimed in claim 25 wherein said saddle includes longitudinally grooved sections on opposite sides of said upright portion, receiving said fasteners.

27. A bridge assembly as claimed in claim 26 wherein said upright portion of the saddle extends as a narrow transverse bridge between said longitudinally grooved sections.

28. A bridge assembly as claimed in claim 27 wherein said upright portion of the saddle has a triangular cross-sectional shape.

29. A bridge assembly as claimed in claim 27 wherein said bridge member has a relatively thin portion on which said platform member rests such that transmitted of said vertical force from the saddle to the sound board cover takes place via said thin portion of the bridge member.

30. A bridge assembly for a string musical instrument having adjustment for string length fine tuning of individual strings of the instrument, said instrument having a resonating box with a vibratable sound board cover on which the bridge assembly is mounted, said bridge assembly comprising a bridge member fixed with respect to the sound board cover of the musical instrument, a block-like platform member securely engaged by said bridge member and having an upper surface disposed above said bridge member, a plurality of saddles on each of which at least one string passes under tension and makes contact with the saddle at a point establishing a vibration length of the string and means connecting each saddle to the platform member for adjustment longitudinally of the respective string to vary a vibration length of the string and thereby effect string length fine tuning thereof, each saddle including spaced longitudinal side portions and a transverse portion connecting said side portions, said transverse portion projecting upwardly to a level above said side portions at a position such that the string contacts and is supported by said transverse portion, said connecting means joining said side portions to said platform member and providing front and rear end positions for longitudinal adjustment of the saddle on the platform member, said transverse portion of the saddle being positioned above said platform member in both said front and rear end positions so that vertical forces applied to the saddle by the string will be transmitted to the sound board cover via the block-like platform member and the bridge member, said platform having a transverse notch thereacross at a location rearwards of said transverse connecting portion at said rear end position of the saddle.

31. A bridge assembly as claimed in claim 30 comprising means for anchoring said string to the sound board cover at a location rearwards of said transverse notch.

32. A bridge assembly as claimed in claim 31 wherein the anchoring means includes a locking pin engagable in said platform member rearwardly of said transverse notch.

33. A bridge assembly for a stringed musical instrument having adjustment for string length fine tuning, the musical instrument having a resonating box with a sound board cover on which the bridge assembly is mounted, said bridge assembly comprising a bridge member fixed with respect to the sound board cover of the musical instrument, said bridge member having a lower surface in contact with and resting on said sound board cover, a block-like platform member secured to said bridge member, said bridge member including a portion of reduced thickness providing a relatively thin portion, said platform member including a lower portion engaged with said portion of reduced thickness, said lower portion having a lower surface in contact with and resting on said thin portion of said bridge member, a saddle on which a string passes under tension, the contact of the string with the saddle establishing a vibration length of the string, and means connecting the saddle to the platform member for adjustment of the saddle, longitudinally of the string, on the platform member to vary the vibration length of the string and thereby effect string length fine tuning, said means providing end positions for the longitudinal adjustment of the saddle at which, and for all positions therebetween, vertical force applied to the saddle by the string will be directly and entirely transmitted to said lower portion of the platform member therebelow and then directly through the contacting surfaces of the platform member and the bridge member to said sound board cover via the thin portion of said bridge member.

34. A bridge assembly as claimed in claim 33 wherein said portion of reduced thickness in said platform member is constituted by a groove provided in said platform member.

35. A bridge assembly as claimed in claim 34 wherein said platform member is fitted in said groove and includes an upper portion projecting out of said groove above an upper surface of said bridge member.

36. A bridge assembly as claimed in claim 33 wherein the musical instrument has a plurality of strings each supported by a respective said saddle, said platform member being a one-piece member supporting all the saddles.

* * * * *